United States Patent [19]

Broel

[11] Patent Number: 4,674,131

[45] Date of Patent: Jun. 23, 1987

[54] DRESS INSERT

[76] Inventor: Bonnie R. Broel, P.O. Box 50506, New Orleans, La. 70150

[21] Appl. No.: 906,418

[22] Filed: Sep. 10, 1986

[51] Int. Cl.[4] ..... A41D 1/22; A41D 17/02; A41C 3/02; A41C 3/10

[52] U.S. Cl. ..... 2/105; 128/481; 128/516; 2/243 B

[58] Field of Search ..... 128/516, 481, 479, 478; 2/105, 243 B

[56] References Cited

U.S. PATENT DOCUMENTS

| | | | |
|---|---|---|---|
| 2,627,606 | 2/1953 | De Grardis | 128/516 |
| 3,312,224 | 4/1967 | Coates et al. | 128/516 |
| 4,398,981 | 8/1983 | Ellis | 128/516 |

*Primary Examiner*—Doris L. Troutman
*Attorney, Agent, or Firm*—C. Emmett Pugh

[57] ABSTRACT

Dress inserts for smoothing the contour lines of dresses improving the appearance in the bosom area and an improved manufacturing method therefor comprising the use of three cut pieces—an outer, liner, an inner lining smaller than the outer lining, and a foam padding layer which is sewn as a unit to and is sandwiched between the inner and outer linings, the method of manufacturing avoiding the need for any trimming step due to the overlapping of too much material. All three pieces have a general oval shape, with "left" and "right" versions begin mirror images of each other, with a triangular or pie shaped section cut out of each of the ovals, so that, when the two diverging edges created by removal of the slice are connected, a natural cone-shape is produced. Because the inner lining is smaller, it supports and raises the outer lining, with the padding providing for correct contouring. In order to produce a smoother seam, the triangular cut-outs are larger than in the prior art, being at least about sixty-five degrees of an arcuate section; so that, when the central, foam padding layer is sewn with a dart, there is no, unacceptably superfluous bulk needing trimming. A second, relatively short sew line is used in forming the cone for the upper, outer lining to produce a fine point at the center of the insert, when one is desired for a more natural look.

19 Claims, 7 Drawing Figures

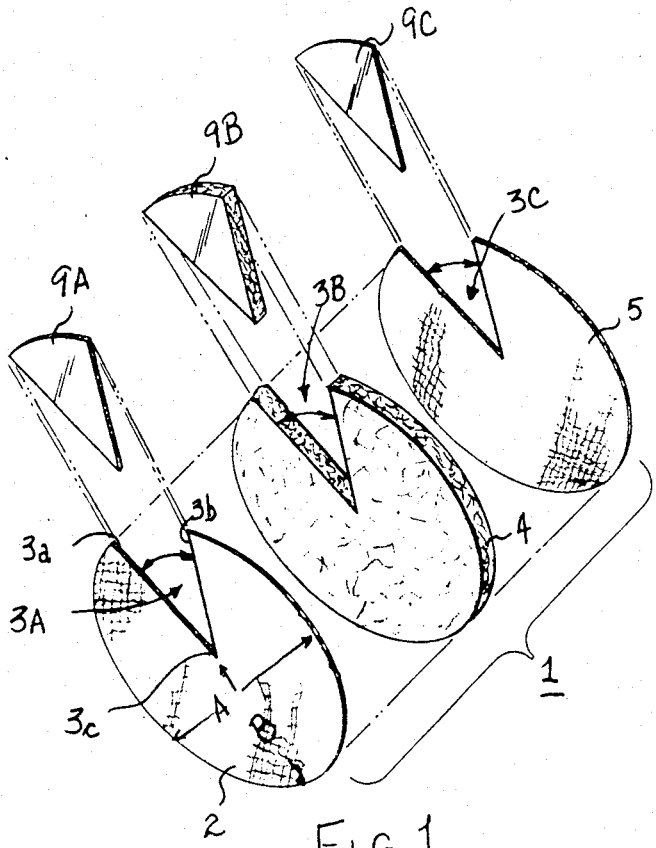
FIG. 1
FIG. 2
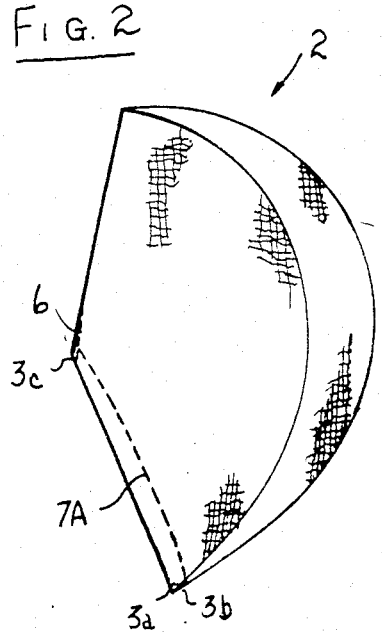
FIG. 3
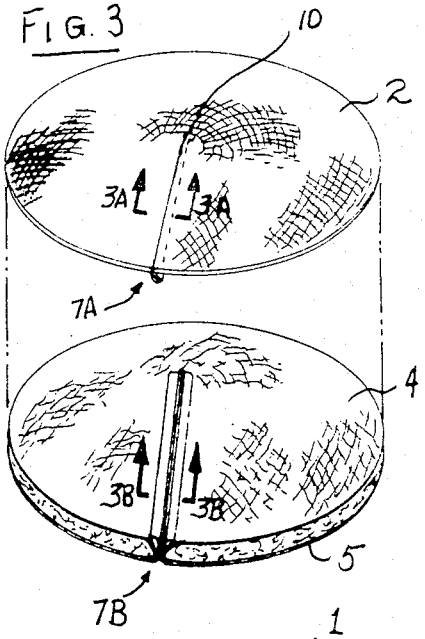
FIG. 3A
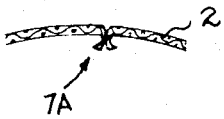
FIG. 3B
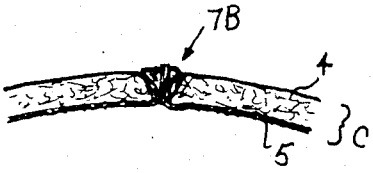
FIG. 5
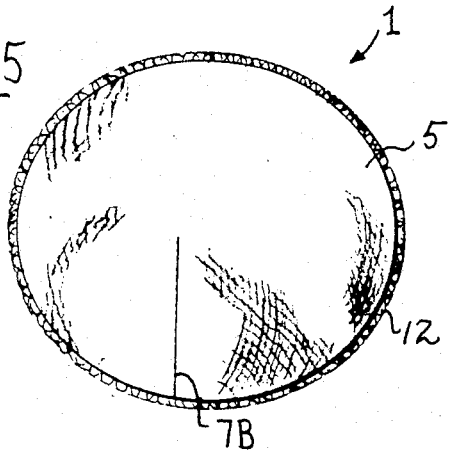
FIG. 4
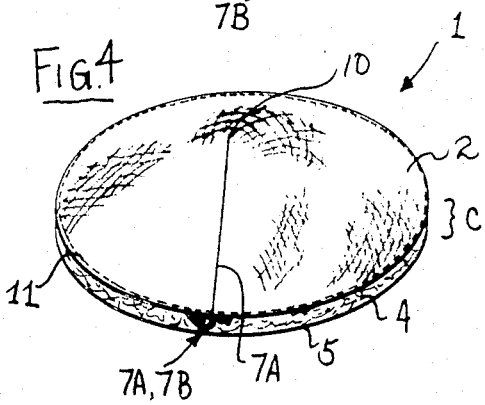

DRESS INSERT

BACKGROUND OF INVENTION

1. Field of Invention

The present invention relates to dress inserts. More particularly, the present invention relates to dress inserts which aid in contouring the lines of garments such as dresses. Still more specifically, the invention relates to inserts contouring lines of the bosom of a blouse or dress top and an improved method of making such inserts.

2. Prior Art & General Background

In prior dress inserts, sewing of both linings separately and also sewing the padding separately, as well as having the inner and outer lining of the same size, produced a padding which was not smooth and which had a ridge or lump where the stitching occurred, which is inconsistent with the purpose of providing well contoured, smooth lines.

In prior dress inserts, the inner and outer linings, as well as the padding, which is between the linings, were seamed separately, where the seams are made, in order to provide the cone shape. Additionally, because the inner and outer linings were of the same diameter before being sewn together, bunching could occur due to the inner lining being of a reduced diameter when completed. Also, the seams produced were relatively bulky, causing the prior art dress inserts not to be as aesthetically pleasing as desired.

In contrast to the earlier prior art, a more recently made dress insert, which has served as an immediate, prior art precursor to the present invention, had the following further comparative characteristics over the preceding art:

(1) more elongated shape;
(2) larger;
(3) a fuller shape with no "point" at its center;
(4) lace edges;
(5) made of, for example, polyester, making it more wearable and washable; and
(6) removable, being attached to the garment only with a basting stitch or pinned.

However, it too, although a substantial improvement over the then prior art, involved a significant overlapping of the foam, center, padding layer, requiring a trimming step in order to achieve the desired smoothness of contour, adding to the time and expense of manufacture. Additionally, a small point at the center of each insert has been desired, but the preceding product was not satisfactory in this regard.

The present invention is designed to overcome all of these prior art problems, producing a most attractive, smoothly contoured, dress insert with a relatively quick and less expensive manufacturing method.

A list of prior patents which may be of interest are listed below:

| Patent No. | Patentee(s) | Issue Date |
|---|---|---|
| 372,909 | | 1887 |
| 3,314,432 | Erteszek | 04/18/67 |
| 4,100,621 | Ettipio | 07/18/78 |

3. General, Summary Discussion of the Invention

The present invention addresses the problem of contouring lines for the bosom area of a dress by introducing a method of manufacture which provides for a smooth dress insert free from apparent lumps or ridges where the seams are made and, when so desired, a projecting point at its center; achieving all of this without the necessity of a trimming step of any excessively overlapped material, which otherwise would make the insert lumpy, requiring it to be trimmed off, adding to the manufacturing time and cost.

Further, the present invention by designing the inner and outer linings in different sizes, the outer being larger than the inner and oval in confirmation, makes an insert which naturally conforms to the desired shape, yet with the present invention doing so without the necessity of any trimming step for excessively overlapped material which had heretofore occurred in forming the cone, particularly in the center, foamed, padding layer. The present invention avoids the trimming step by increasing the triangular, pie shaped cut-out in forming the three layers to have an angle in excess of about sixty-five degrees. Additionally, a second, relatively short sew line is included across the tip of the triangular cut out or center in forming the outer liner into a cone shape, the second sew line causing the central outer area of the liner to have a relatively finely defined point at its center for a more natural look, when such is desired.

It is noted that the dress or garment insert of the present invention gives a certain degree of support and obviates the need of a bra. In contrast to the earlier prior art, wherein the "bra" type supporting element was permanently secured between the liner and the dress itself, it is noted that the dress inserts of the present invention are merely temporarily secured with for example a basting stitch or is pinned which allows for removal for washing or use with another garment.

It is thus the basic object of the present invention to provide a dress insert made by a manufacturing method which is as cost effective as reasonably possible, while providing a smoothly contoured dress insert that is at least as good as that of the most recent prior art, yet cheaper and easier to manufacture, and permits the addition of central located point when desired for a more natural look.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is an exploded view of the two, cut, unattached lining pieces with the cut, unattached, inner, foam padding piece, also illustrating in an exploded array the triangular pieces that have been cut out of each to cause the inner padding layer to form the cone shape, when the three elements are assembled and sewn together in accordance with the method of the present invention.

FIG. 2 is a plan view of the outer lining piece folded over at the cut-out edges and sewn, with the additional sew line included to form a well shaped point at the insert's center, the oval shape of the cut piece being apparent from the lack of coincidence at the right side edges.

FIG. 3 is an exploded, perspective view showing how the joined inner lining and padding layer are assembled with the sewn outer layer in the preliminary stage to the final, peripheral sewing step to produce the fully assembled, three piece dress insert of FIG. 4.

FIGS. 3A & 3B are side cross-sectional views of the sewn outer liner and the assembled and sewn inner lining and padding taken along cross-sectional lines 3A—3A & 3B—3B, respectively, of FIG. 3, showing the darts or seams where the two cut edges of the linings and padding layer are joined.

FIG. 4 is a top, perspective view of the completely assembled and sewn dress insert, completely finished except for the addition of the peripheral lace.

FIG. 5 is a bottom or underside view of the finished dress insert, including the addition of the peripheral lace.

DETAILED DESCRIPTION OF THE PREFERRED, EXEMPLARY EMBODIMENT

As will be described in detail below, each of the preferred embodiments of the dress inserts 1 includes an outer lining 2, a padding layer 4 and an inner lining 5, all cut, joined and sewn together using the preferred method of the present invention described below.

As can be seen in FIG. 1, the outer and inner lining pieces 2, 5 and the batting or padding 4 between the two patterns each has a pie or triangularly-shaped open area (3A, 3B & 3C), where a sliver (9A, 9B & 9C), having an angle in excess of about sixty-five degrees, of the lining or batting similarly shaped has been removed. Two, diagonally diverging edges 3*a* and 3*b* are formed by the removal of the pie or triangularly-shaped slice.

Referring to FIG. 2, it can be seen that for the outer lining piece 2 the two edges 3*a* & 3*b* are brought and sewn together connected by a seam 7A, preferably a type of seam known in the art as a dart (see also FIG. 3A). As can be seen in FIGS. 3A & 4 the seam 7A is smooth ad well defined on its outer side.

If it is desired to have a point slightly protruding at the outer center 10 of the insert for a more natural look, a second, relatively short sew line 6 diagonally disposed to the seam 7A is included in the sewing step of joining the edges 3*a* & 3*b* together, as illustrated in FIG. 2. This causes the outer lining 2 to form a nicely defined, firm tip or point in the central area 10.

The inner and outer linings 5 and 2, respectively, may be made of a material suitable for such linings, such as for example silk, polyester, acetate or taffeta. The inner padding 4 may be made of suitable padding material, such as for example foamed polyester quilting or batting.

Referring to FIGS. 3 & 3B, it can be seen that the inner lining 5 and batting 4 are also sewn together by a dart or seam 7B. Seam 7B is a single seam for both the batting 4 and inner lining 5, allowing for a lesser bulge along this seam line. Additionally, the inner batting or padding 4 need not be darted or folded over as in the earlier prior art. Instead, ends 3*a* and 3*b* of inner padding 4 and the edges 3*a* & 3*b* are overlapped together to form four layers along the seam 7B.

This absence of an extra dart and the consequent absence of additional folding, not found in the earlier prior art, further prevents the formation of a lump or destruction of the desired contour in this area. In the earlier art, all three sections—the two linings and the padding, were darted separately, and, even in the precursor product, substantial overlapping occurred, requiring an extra trim step to prevent noticeable bulging or bunching in the finished dress insert.

As one of the final steps in making the insert 1, the circumferential peripheries of all the cone-shaped sections 2, 4 and 5 are sewn together about their circular peripheries as a unit with a single stitching or set of stitching shown as 11 in FIG. 4. In this way all of the sections are connected together to prevent slipping of any of them relative to each other and possible subsequent bunching, which would, if allowed, also destroy the contour sought to be given by the inserts 1.

The configuration and size of the upper or outer liner 2 and and padding 4 are substantially the same. The size of the bottom or inner lining 5 however is smaller. The inner, smaller section 5 forms a cone shape due to the connecting of ends 3*a* and 3*b*, as do the other two pieces 2 and 4. In this way, the inner "cone" liner 5 helps support, form and hold the cone shape of the outer lining 2, further contributing to the firmness and therefore the contour of the dress. The cone shape formed by lining 5 fits inside of the cone configurations formed by the outer lining 2 and the padding 4 and is of lesser diameter to prevent bunching.

The general cone shape of the assembled three pieces 2, 4 & 5 is consistent with the contour sought to be developed by the inserts 1. It should be noted that the desired contour may be controlled by varying the size of the pie or triangularly shaped slices 9A–C removed, so that the cone-shaped has a greater or lesser height-to-base area ratio. Further, the inner lining 5 may have its slice 9C in a little bit larger size the the slice 9A from the outer lining 2. Ideally, all of the cut-outs 9A–C should have occupied an arcuate angle of at least about sixty-five degrees, in comparison to about forty-eight to about fifty-eight degrees used in the precursor product. As a result, the seam 7B is formed without the necessity of trimming any excessive edge as shown in FIG. 3B, which was necessary in the precursor product to the present invention.

It should be further noted that the padding 4 is also made to be consistent with the diameter of the inner lining 5, so that it could be attached in the same manner as described above by means of the dart 7B to the inner lining 5 and attached to the outer lining only at its circumference.

In the preferred embodiment, the width of the base of the outer lining, shown as dimension A in FIG. 1, may be for example six inches and a half inches, while the height (dimension B in FIG. 1) of the outer liner 2 could be for example three and three-quarters inches to the bottom edge of the cut-out 3A (and for example three and a half inches for the corresponding dimension for the inner liner 5) and five-and-a-half inches in overall height. The cut-out angle (note curved directional arrows in FIG. 1) for the diverging edges 3*a*, 3*b* could be for example about seventy-five degrees, with the dart 7A being of the order of three to three and a quarter inches in length along the edges 3*a*, 3*b*. The second sew line 6 for the fine central point can be for example of the order of about a half or to about three-quarters inch in length across the tip 3*c* which lies at the center area of the outer liner 2.

The thickness of the insert 1 may be of the order of, for example, three-eighths of an inch without compression, as shown in FIG. 4 as dimension C. The thickness of the foam padding 4 also may be approximately for example three-eighths of an inch, the further thickness added by the linings 2 and 5 being negligible. The dress inserts 1 can be of whatever desired material, provided in various colors beside white, including for example, pink, black, red, etc.

The foregoing details are of course merely exemplary and subject to substantial variation.

It should be noted that, although the elements 2, 4 & 5 are described as ovals or cone-shaped, they can be of somewhat irregular shape and a mathematically precise oval or cone shape is not critical, shapes at least generally of that configuration being sufficient.

Since two such garment inserts are necessary, a "left" one and a "right" one (being mirror images of one another), the two may be connected by a string of suitable length in order to keep them together.

It is desirable for aesthetic purposes to add an attractive lace design 12 around the periphery of the garment insert in the finishing process, such as for example three-eighths inch edging of an ornamental lace. The dress inserts can be used with any feminine garment, and the term "dress" as used herein should be considered synonymous with any feminine garment having a portion which covers the upper torso or breast area, commonly termed the bosom, but it is noted that the dress inserts are particularly efficacious when used with a low cut gown with a plunging neck line.

Thus, it can be seen that the preferred method of the present invention to make the preferred embodiment of the dress inserts 1 includes the following steps:

(a) taking finished material such as for example taffeta and cutting two, at least generally oval shaped pieces of finished material to form the outer and inner linings 2 & 5, the outer 2 being a little larger in overall size and the inner lining 5;

(b) cutting an at least generally oval shaped piece of batting or foam to form the batting or padding layer 4;

(c) removing triangular, similarly sized and configured pie-shaped pieces 9 from the inner and outer linings 5 & 2 and the padding layer 4, producing opposed, spaced, side edges 3*a* & 3*b* diverging away from each other where the pie-shaped pieces 9 had been located, with the triangularly-shaped pieces preferably being in excess of about sixty-five degrees;

(d) folding the opposed, spaced, side edges 3*a* & 3*b* of the outer lining 2 together and sewing the juxtapositioned side edges together to form a dart 7B, forming an at least generally cone shape when folded or spread out; and, if desired, while the liner 2 is still folded, sewing a second line 6 in the central area 10 to form a relatively finely formed point for a more natural look, (e) pulling the opposed, spaced, side edges 3*a* & 3*b* of said padding 4 together, forming an at least generally cone shape, and placing the inner layer 5 on the underside of the now cone-shaped padding layer 4 with the opposed, side edges 3*1* & 3*b* of the inner lining in juxtaposition to the side edges 3*a* & 3*b* of the padding layer 4 and sewing the four, layered, juxtapositioned side edges 3*a* & 3*b* of the padding layer 4 and the inner lining 5 together to form a dart;

(f) positioning the outer lining 2 on the upper, outer side of the joined padding layer and inner lining, with the outer lining's darted opposed, spaced side edges 3*a* & 3*b* located over and facing the dart 7B formed in joining the inner lining 5 to the padding 4;

(g) sewing the peripheries of the inner and outer linings and said padding layer together, forming the cone-shaped dress insert 1 having a smoothly contoured, outer and inner finished surfaces;

(h) attaching a lace 12 around the periphery of the dress insert 1, producing a more attractive and aesthetically pleasing insert; and (i) providing a pair of the finished dress inserts to the end user.

The end user then places the pair of dress inserts into a dress in its bosom area, preferably with only temporary-type fastenings, allowing for the easy removal of the dress inserts 1 from the dress and possible re-use of the inserts 1 in another dress.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed is:

1. A method of providing a dress insert for smoothing out the contour lines of a dress in the bosom area, which dress insert includes a. a cone shaped bottom, inner lining made of a finished material;

b. a centrally located, cone-shaped batting or padding layer made of foam or other padding material of height and base periphery similar to the inner lining, said padding layer being attached to said inner lining at a dart where the cone shapes are sewn together and also connected at the circumference of the two cone shapes; and c. a cone-shaped, top, outer lining made of finished material having a base periphery greater than that of said inner lining and padding, said outer lining being connected to said inner lining and said padding layer at its circumference;

comprising the steps of:

(a) taking finished material and cutting two, at least generally oval shaped pieces of finished material to form the outer and inner linings, the outer being a little larger in overall size than the inner lining;

(b) cutting an at least generally oval shaped piece of batting or foam to form the batting or padding layer;

(c) removing triangular, similarly sized and configured pie-shaped pieces, each being at least about sixty-five degrees in arcuate section, from the inner and outer linings and the padding layer, producing opposed, spaced, side edges diverging away from each other at an angle of at least about sixty-five degrees where the pie-shaped pieces had been located;

(d) folding the opposed, spaced, side edges of the outer lining together and sewing the juxtapositioned side edges together to form a dart, forming an at least generally cone shape when the outer lining is unfolded;

(e) pulling the opposed, spaced, side edges of said padding layer together, forming an at least generally cone shape, and placing the inner layer on the underside of the now cone-shaped padding layer with the opposed, side edges of the inner lining in juxtaposition to the side edges of the padding layer and sewing the four, layered, juxtapositioned side edges of the padding layer and the inner lining together to form a dart;

(f) positioning the outer lining on the upper, outer side of the joined padding layer and inner lining, with the outer lining's darted opposed, spaced side edges located over and facing the dart formed in joining the inner lining to the padding; and (g) sewing the peripheries of the inner and outer linings and said padding layer together, forming the at least generally cone-shaped dress insert having a smoothly contoured, outer and inner finished surfaces.

2. The method of claim 1, wherein there is included the further step of:

(h) attaching a lace around the periphery of the dress insert, producing a more attractive and aesthetically pleasing insert.

3. The method of claim 1, wherein there is further included the steps of:

(i) providing a pair of said finished dress inserts; and (j) placing said pair into a dress in its bosom area with only temporary-type fastenings, allowing for the easy removal of said dress inserts from the dress.

4. The method of claim 1, wherein there is further included in step "d" the sub-step of:

(d-1) while the liner is still folded, sewing a second, relatively short line in the central area to form a relatively finely formed point when the outer liner is formed into an at least generally cone-shape.

5. The method of claim 4, wherein there is included in step "d-1" the further sub-step of:

(d-2) sewing a line approximately a half to about three quarters of an inch in length.

6. A dress insert for smoothing out the contour lines of a dress in the bosom area, comprising:

a. an at least generally cone-shaped outer lining made of a finished material and having a central area, said outer lining having been formed of a flat piece of material with a triangularly or pie shaped piece cut out having an arcuate section of at least about sixty-five degrees, with the diverging side edges of the cut-out area joined together with a dart;

b. an at least generally cone-shaped batting or padding made of foam or other padding material of height and base diameter and configuration similar to said outer lining, said padding being attached to said outer lining at their circumferences; and c. at least generally cone-shaped inner lining made of finished material having a base diameter less than that of said outer lining, said inner lining and said padding being connected together by a dart at their diverging edges forming four, sewn layers at said dart, said inner lining and said padding being connected to said outer lining and said batting only about their circumferential areas.

7. The dress insert of claim 6, wherein said cone-shaped outer lining includes a second sew line across the tip or mouth of the diverging edges, forming a finely formed point in the central area of said outer liner.

8. The dress insert of claim 7, wherein said second sew line is about a half to about three quarters of an inch in length.

9. The dress insert of claim 6, wherein said cone-shaped batting provides a padding having a pair of opposed planar, at least generally oval-shaped, upper and lower surfaces separated by the body of the padding.

10. The dress insert of claim 9, wherein said cone shaped batting has a pie shaped void extending radially inward from its periphery bounded by a pair of edges extending radially outward from a common midpoint of said batting to its periphery.

11. The dress insert of claim 10, wherein the pie shaped void taken from said inner lining has a longer chord than a chord of said outer lining taken along an equal radius from its midpoint for providing a larger pie shaped void in said inner lining.

12. The dress insert of claim 11, wherein the pie shaped void in said inner lining is aligned with the pie shaped void in said batting.

13. The dress insert of claim 12, wherein said batting is positioned with one of its planar sides in contact with said outer lining and with its circular periphery, its midpoint and its void mutually aligned with the circular periphery, the midpoint and the void of said outer lining.

14. The dress insert of claim 13, wherein the edges of said batting and said outer lining are brought together and aligned, with a planar portion of said outer lining extending past the edges of said outer lining forming a juxtaposed, tapering contact from a point on the periphery of said inner lining to its midpoint, the edges of said batting being separated by the juxtaposed contact of the edges of said outer lining and juxtaposed thereon in co-alignment with the point on the periphery of said outer lining along the tapering contact of the edges of said outer lining, the aligned edges being attached together by stitching along a radius from their co-alignment to their aligned midpoint.

15. The dress insert of claim 14, wherein the attachment of the aligned edges by stitching forms said cone shaped batting and said cone shaped outer lining with said cone shaped inner lining being located under said cone shaped batting with its midpoint and apex aligned below and in contact with the midpoint and apex of said cone shaped batting, and with their peripheries aligned for forming their collective circumference.

16. The dress insert of claim 15, wherein said aligned edges are folded over for forming a sandwiched, darted edge having a fold which tapers from their collective circumference to their aligned midpoint.

17. The dress insert of claim 16, wherein said outer lining has a darted edge formed by folding under a portion of one of its edges along a radius extending outward from its midpoint to its periphery for providing a fold which tapers from its periphery to its midpoint.

18. The dress insert of claim 17, wherein said outer lining is positioned on top of said batting and on the opposite side of said batting with its darted edge and the sandwiched, darted edge of said batting and said inner lining located directly below the dart of said outer lining.

19. The dress insert of claim 18, wherein the circumference surrounding said outer lining is aligned with the collective circumference of said batting and said inner lining and the aligned circumferences are attached by stitching along their aligned peripheries forming an integrated dress insert.

* * * * *